US005947150A

United States Patent [19]

Ryan

[11] Patent Number: 5,947,150

[45] Date of Patent: Sep. 7, 1999

[54] FREEZELESS DRIPPING WALL FAUCET-HYDRANT

[76] Inventor: John Patrick Ryan, P. O. Box 227, Long Valley, N.J. 07853

[21] Appl. No.: 08/881,538

[22] Filed: Jun. 24, 1997

[51] Int. Cl.[6] ..... F16L 5/00

[52] U.S. Cl. ..... 137/360; 137/625.33

[58] Field of Search ..... 137/625.28, 625.33, 137/360

[56] References Cited

U.S. PATENT DOCUMENTS

| | | | |
|---|---|---|---|
| 1,185,970 | 6/1916 | Bower | 137/625.33 |
| 3,095,905 | 7/1963 | Glauber | 137/625.33 |
| 3,446,226 | 5/1969 | Canterbury | 137/62 |
| 4,066,090 | 1/1978 | Nakajima et al. | 137/62 |
| 4,205,698 | 6/1980 | Hucks | 137/62 |
| 4,296,770 | 10/1981 | Rice | 137/62 |
| 4,344,450 | 8/1982 | Walters | 137/62 |
| 4,437,481 | 3/1984 | Chamberlin et al. | 137/60 |
| 4,460,006 | 7/1984 | Kolze | 137/62 |
| 4,475,570 | 10/1984 | Pike et al. | 137/218 |
| 4,484,594 | 11/1984 | Alderman | 137/62 |
| 4,638,828 | 1/1987 | Barrineau, Sr. et al. | 137/62 |
| 4,657,038 | 4/1987 | Lyons | 137/62 |
| 4,784,173 | 11/1988 | Carney | 137/2 |
| 4,809,727 | 3/1989 | Chamberlin | 137/62 |
| 4,909,270 | 3/1990 | Enterante, Sr. et al. | 137/107 |
| 4,932,429 | 6/1990 | Watanabe et al. | 137/62 |
| 4,971,097 | 11/1990 | Hunley, Jr. et al. | 137/218 |
| 5,129,416 | 7/1992 | Ackroyd | 137/218 |
| 5,158,105 | 10/1992 | Conway | 137/296 |

*Primary Examiner*—A. Michael Chambers

[57] ABSTRACT

A freezeless faucet has a body, a nozzle, and a shaft that expands and contracts thermally, moving a resilient plug. The plug has an orifice through it and a beveled surface closing and sealing against a seat beveled surface to stop water flow. Further closing force against the beveled surfaces causes the plug to compress radially inward, closing the orifice. A drop in temperature below freezing will cause the shaft to contract, reducing the plug radial compression, allowing the orifice to open and water to drip through. This prevents upstream piping from freezing. An air vent valve selectively admits air into the faucet body to allow draining of water from the body and nozzle, and to prevent siphoning of contaminants into the water supply. A shaft handwheel includes a heat sink, to shorten the thermal response time of the shaft to rapid temperature changes.

14 Claims, 4 Drawing Sheets

FREEZELESS DRIPPING WALL FAUCET-HYDRANT

FIELD OF THE INVENTION

This invention relates generally to the field of thermally actuated valves, and pertains, more specifically, to a water faucet that allows dripping flow under freezing conditions to prevent freeze damage to piping, and allows draining of water from the faucet and from a hose connected to the faucet.

BACKGROUND OF THE INVENTION

Freezing of piping and faucets in external walls or poorly heated areas often results in ruptured plumbing, wasted water, and water damage to a building. A common solution is to crack the faucet open sufficiently to allow slow dripping. The flowing water is warm enough to prevent freezing of piping upstream of the faucet. In the event the piping should freeze anyway, the pressure of expanding ice is relieved. However, faucet dripping is not always feasible, as homeowners are not home, or forget, or a cold night is not expected. In addition, an air bleed should be provided to drain water from the faucet to further prevent freezing, and to preclude siphoning of dirty water back into the supply.

Faucets and hydrants which allow dripping of water and anti-siphon are known and, heretofore, have been configured in various ways. Some examples of such faucets are seen in the following U. S. Patents:

Chamberlin, U.S. Pat. No. 4,809,727, discloses a thermally contracting and expanding rod that opens and closes a valve to provide flow;

Canterbury, U.S. Pat. No. 3,446,226, Nakajima, U.S. Pat No. 4,066,090, Rice, U.S. Pat. No. 4,296,770, Kolze, U.S. Pat. No. 4,460,006, Alderman, U.S. Pat. No. 4,484,594, Barrineau, U.S. Pat. No. 4,638,828, Chamberlin, U.S. Pat. No. 4,437,481, Carney, U.S. Pat. No. 4,784,173, Walters, U.S. Pat. No. 4,344,450, and Hucks, U.S. Pat. No. 4,205,698, employ thermally expanding or contracting fluids to actuate the drip valve at a predetermined temperature;

Watanabe, U.S. Pat. No. 4,932,429, uses a shape-memory alloy to actuate the drip valve at a predetermined temperature;

Lyons, U.S. Pat. No. 4,657,038, shows a thermally actuated electric switch that opens a solenoid operated valve to provide flow;

Pike, U.S. Pat. No. 4,475,570, Enterante, Sr., et al, U.S. Pat. No. 4,909,270, Breneman, U.S. Pat. No. 4,821,762, Ackroyd, U.S. Pat. No. 5,129,416, Conway, U.S. Pat. No. 5,158,105, and Hunley, U.S. Pat. No. 4,971,097, illustrate a hydrant that admits air to displace and drain water after shutting off the valve.

None of the above-described devices combine both a thermally actuated drip valve with an anti-siphon feature. The prior art devices are subject to distortion and damage to the valve seating surfaces by excessive torque applied to the handle. Further damage to the seat and leakage is possible from misalignment of the seating surfaces. The thermal actuation of these devices is subject to time delay due to the thermal element being surrounded by layers of material and structure. This slows the heat transfer required for actuation, placing piping at risk during periods of plummeting temperatures.

Accordingly, there is a need to provide a faucet having both a thermally actuated drip valve so as not to freeze, and an anti-siphon bleed valve to avoid contaminating the water supply. There is a further need to provide a stop to limit damage to the valve seating surfaces by excessive torque applied to the handle. A yet further need is to provide self alignment of the seating surfaces to prevent damage to the seat and leakage. Another need is to provide a heat sink to conduct heat from the thermal actuator to the ambient air to shorten response time in the event of rapid temperature change.

SUMMARY OF THE INVENTION

The above features, as well as further features and advantages, are attained by the present invention which may be described briefly as a freezeless faucet for use in connection with a water supply. The faucet comprises a body extending between a first end connected to the water supply and an opposite second end. The body has a bore therethrough. The body also has a nozzle intermediate the first and second ends, the nozzle communicating with the bore for discharging water. The bore has an annular bore seat intermediate the nozzle and the first end, the bore seat having a beveled surface facing the body second end.

A resilient plug is disposed within the bore. The plug has an orifice therethrough communicating with the bore. The plug also has an outer periphery with a beveled surface. The plug is movable from a closed position in which the plug beveled surface is juxtaposed sealingly against the bore seat beveled surface, to an open position in which the plug beveled surface is apart from the bore seat.

A shaft is threadingly mounted generally collinearly within the bore. The shaft extends between a first end connected to the plug and an opposite second end extending beyond the body second end. A handwheel is attached to the shaft second end for rotation therewith.

Thus, as the handwheel is rotated in a first direction, the shaft moves the plug into the closed position to stop water flowing past the bore seat and around the plug periphery. The beveled surfaces cause the plug to compress radially inward, closing the orifice to stop water flowing therethrough. As the handwheel is rotated in an opposite second direction, the shaft moves the plug into the open position to allow water to flow past the bore seat, around the plug periphery, and toward the nozzle. The plug radial compression is relieved, allowing the orifice to open and water to flow therethrough. With the plug in the closed position, a decrease in ambient temperature generally below freezing will cause the shaft to contract, thereby reducing the plug radial compression, allowing the orifice to open sufficiently for water to drip therethrough. This prevents upstream piping from freezing.

BRIEF DESCRIPTION OF THE DRAWING

The invention will be more fully understood, while still further features and advantages will become apparent, in the following detailed description of preferred embodiments thereof illustrated in the accompanying drawing, in which.

DESCRIPTION OF THE PREFERRED EMBODIMENTS

Figure 1:
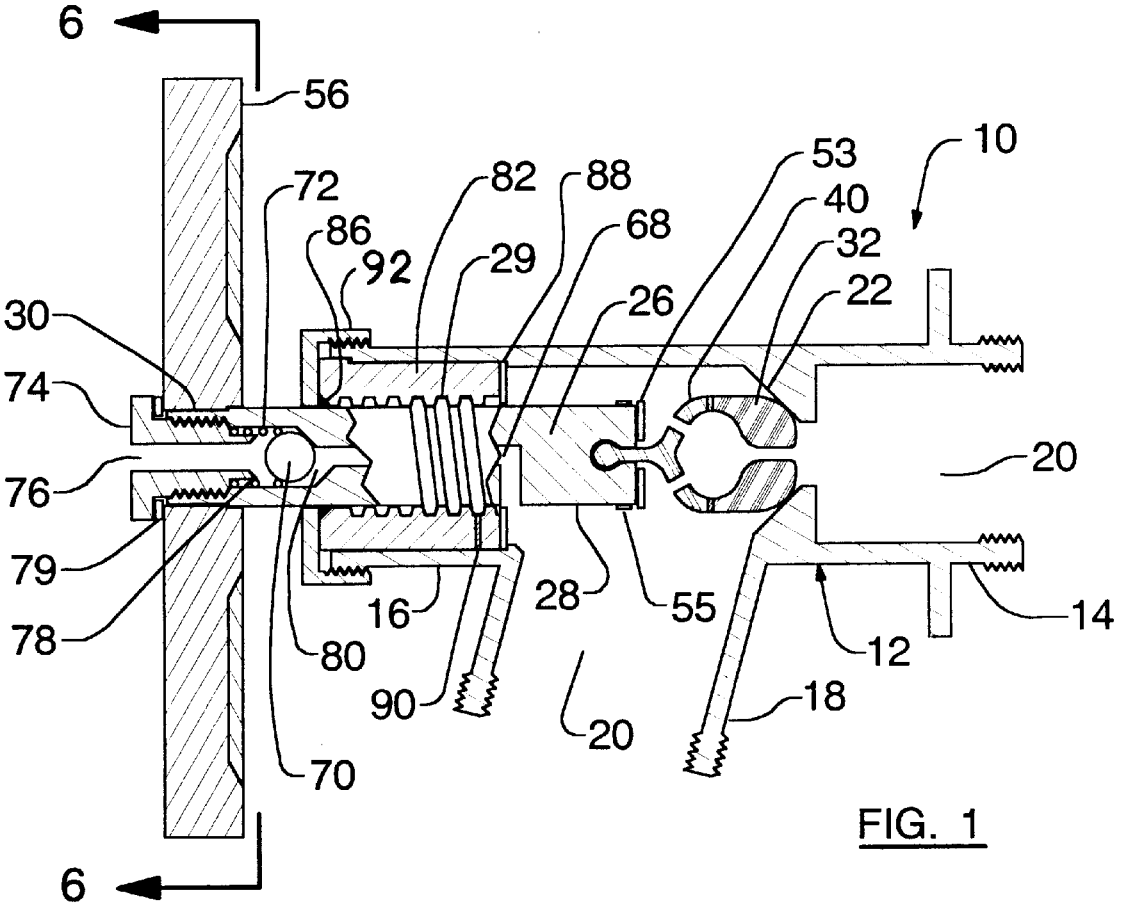
FIG. 1 is a side elevational, cross-sectional view of a freezeless faucet constructed in accordance with the invention.
Figure 2:
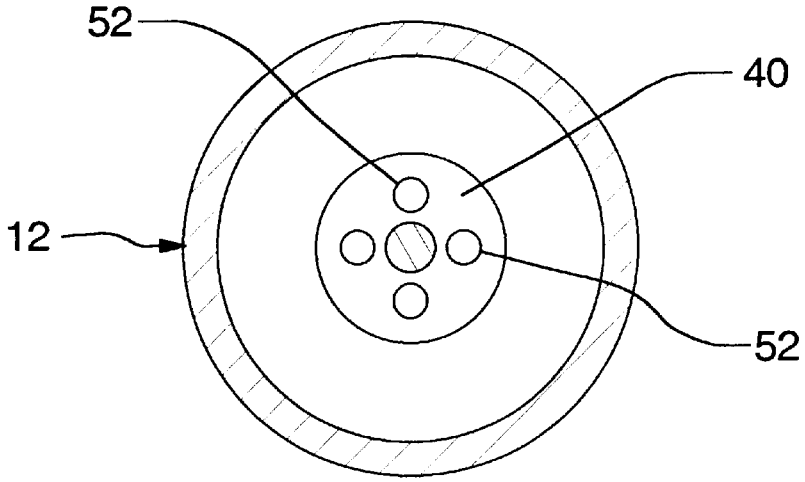
FIG. 2 is a cross-sectional view of the freezeless faucet of FIG. 1, taken along lines 2—2 of FIG. 3, showing the backing member and the body.

Referring now to the drawing, and especially to FIGS. 1, 2, 3 and 4, a freezeless faucet is shown at 10, and is for use in connection with a water supply. The faucet comprises a body 12 extending between a first end 14 connected to the water supply and an opposite second end 16. The body 12 has a bore 20 therethrough. The body 12 also has a nozzle 18 intermediate the first 14 and second 16 ends. The nozzle 18 communicates with the bore 20 for discharging water. The bore 20 has an annular bore seat 22 intermediate the nozzle 18 and the first end 14. The bore seat 22 has a beveled surface 24 facing the body second end 16.

A shaft 26 having threads 29 is threadingly mounted generally collinearly within the bore 20. The shaft 26 extends between a first end 28 and an opposite second end 30 extending beyond the body second end 16. The shaft first end 28 includes a generally spherical socket 31. A handwheel 56 is attached to the shaft second end 30 for rotation therewith. The handwheel 56 includes a plurality of heat transfer surfaces 57 forming a heat sink, so as to shorten the thermal response time of the shaft 26 to rapid temperature changes.

A resilient plug 32 is disposed within the bore 20. The plug 32 has an orifice 34 therethrough communicating with the bore 20. The plug 32 has an outer periphery 36 with a beveled surface 38. The plug 32 is movable from a closed position in which the plug beveled surface 38 is juxtaposed sealingly against the bore seat beveled surface 24, to an open position in which the plug beveled surface 38 is apart from the bore seat beveled surface 24.

A backing member 40 has a conical portion 42, with a convex side 44, and a concave side 46 facing the plug 32. The conical portion 42 has a periphery 48 attached to the plug 32 forming a cavity 50 communicating with the orifice 34. The conical portion 42 has at least one hole 52 therethrough communicating the cavity 50 with the bore 20 downstream of the plug 32. Thus, water passing through the orifice 34 will pass through the cavity 50 and through the hole 52, as shown by arrow 58 in FIG. 3. The backing member 40 has a pivot ball 54 attached to the conical portion convex side 44. The pivot ball 54 is disposed within the socket 31. This allows the plug 32 to align with the bore seat 22 for watertight sealing, and to prevent the plug 32 from rotating with respect to the shaft 26, to minimize plug wear. A retainer band 55 serves to keep the pivot ball 54 from slipping out of the socket 30. An isolation washer 53 helps to minimize heat transfer from the water to the shaft first end 28.

Figure 3:
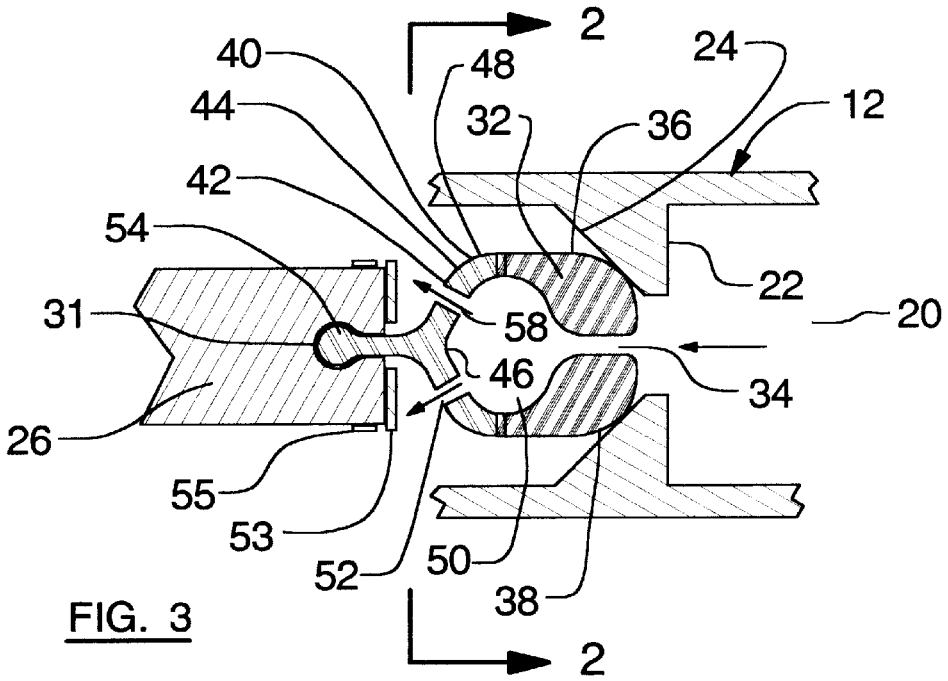
FIG. 3 is an enlarged, partial, cross-sectional view of the freezeless faucet of FIG. 1, showing the plug, backing member, and the shaft first end, with the plug partially open to flush the system.
Figure 4:
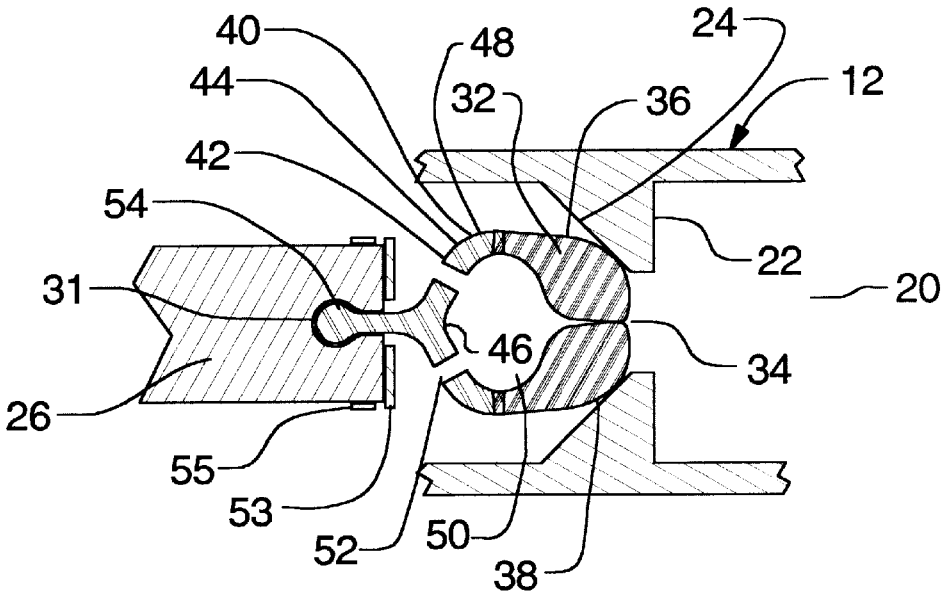
FIG. 4 is an enlarged, partial, cross-sectional view of the freezeless faucet of FIG. 1, showing the plug, backing member, and the shaft first end, with the plug in the drip mode.

In operation, as the handwheel 56 is rotated in a first direction, the shaft 26 moves the plug 32 into the closed position to stop water flowing past the bore seat 24 and around the plug periphery 36. The beveled surfaces 24 and 38 cause the plug 32 to compress radially inward, closing the orifice 34 to stop water flowing therethrough. As the handwheel 56 is rotated in an opposite second direction, the shaft 26 moves the plug 32 away from the seat 22 enough to reduce the radial compression, as shown in FIG. 3. This opens the orifice 34, and water flows under pressure through the orifice 34, through the cavity 50, and through the backing member holes 52, and into the bore 20. This flushes debris from the orifice 34, cavity 50, and holes 52. Further rotation of the handwheel 56 moves the plug 32 fully away from the seat 22 and into the open position (not shown) to allow water to flow past the bore seat 24, around the plug periphery 36, and toward the nozzle 18. The plug 32 radial compression is relieved, allowing the orifice 34 to open and water to flow therethrough. With the plug 32 in the closed position, a decrease in ambient temperature generally below freezing will cause the shaft 26 to contract, thereby reducing the plug 32 radial compression, allowing the orifice 34 to open sufficiently for water to drip therethrough. This prevents upstream piping from freezing.

Figure 5:
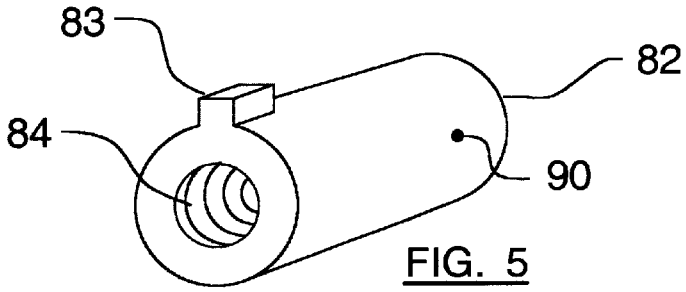
FIG. 5 is an isometric view of the bushing from the freezeless faucet of FIG. 1.
Figure 7:
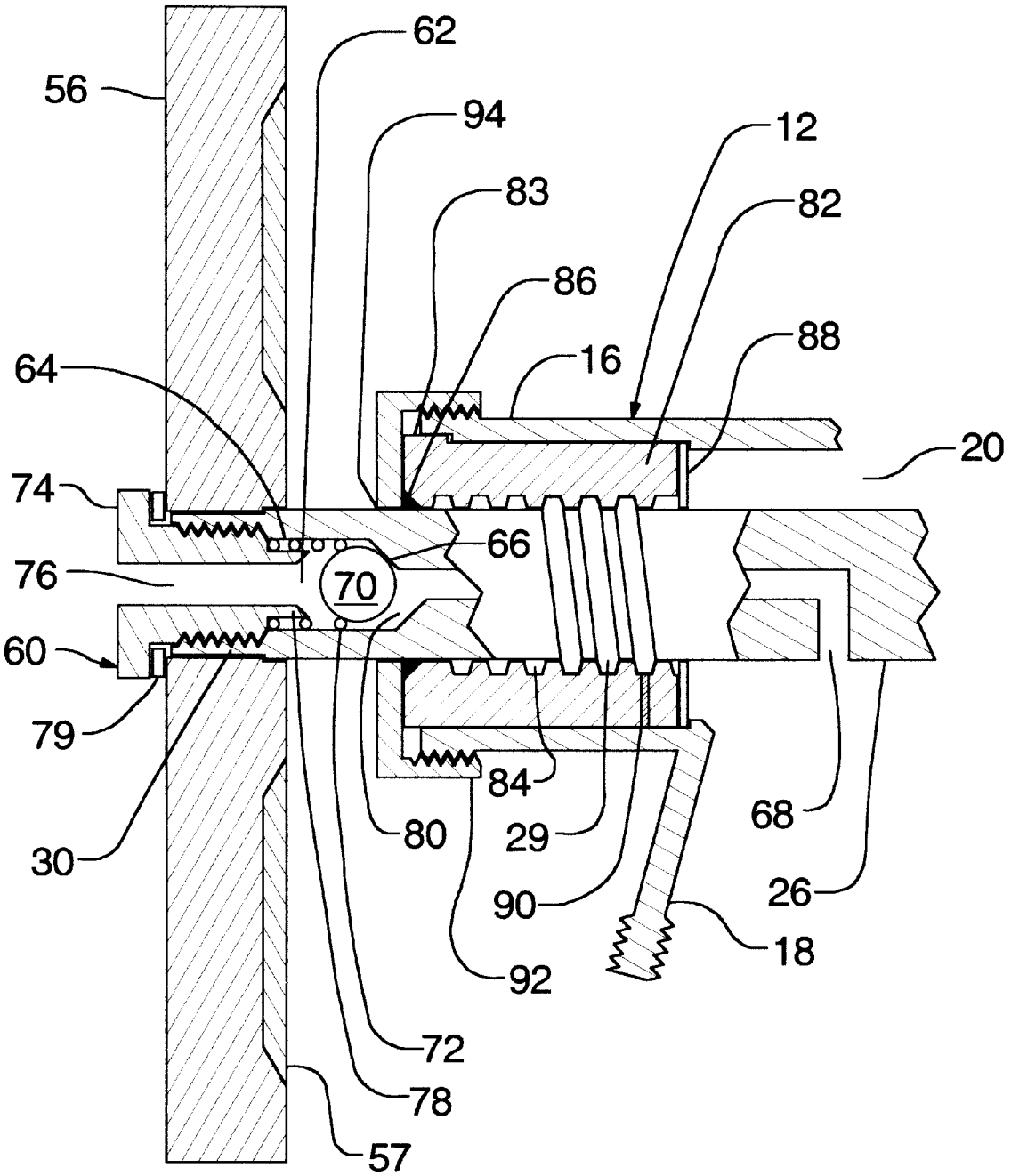
FIG. 7 is an enlarged, partial, cross-sectional view of the freezeless faucet of FIG. 1, showing the air vent valve, the bushing, and seals.

Turning now to FIGS. 5 and 7, as well as FIG. 1, an air vent valve 60 selectively admits air into the body 12 to allow draining of water from the bore 20 and nozzle 18, and to prevent siphoning of contaminants into the water supply. The shaft second end 30 includes a vent cavity 62 generally collinear with the shaft 26. The vent cavity 62 extends from a proximal end 64 adjacent the shaft second end 30 to an opposite distal end 66.

The shaft 26 includes a vent passage 68 communicating the vent cavity distal end 66 with the bore 20. The air vent valve 60 includes a valve ball 70 disposed within the vent cavity 62. The valve ball 70 is smaller in diameter than the vent cavity 62. The air vent valve 60 has a spring 72 biasing the valve ball 70 toward the vent cavity distal end 66. The air vent valve 60 includes a vent screw 74 threadingly engaging the shaft second end 30. The vent screw 74 has a hole 76 therethrough and a vent seat 78 closely juxtaposed with the valve ball 70. The vent screw 74 is threadingly movable from a closed position wherein the vent seat 78 sealingly engages the valve ball 70 and holds the valve ball 70 against the distal end 66, to an open position wherein the vent seat 78 is spaced apart from the valve ball 70 allowing the vent cavity 62 to communicate with ambient air. A vent washer 79 seals the vent screw 74 threaded opening against leakage. The shaft 26 includes a vent bypass 80 at the vent cavity distal end 66 allowing air to flow freely around the valve ball 70 at the distal end 66.

In operation, with the vent screw 74 in the closed position, fluids cannot flow past the valve ball 70. With the vent screw 74 in the open position and the plug 32 in the closed position, ambient air will flow through the vent screw hole 76, past the vent seat 78, around the valve ball 70, through the vent bypass 80 and the vent passage 68, and into the bore 20, displacing and allowing water to drain from the bore 20. With the vent screw 74 in the open position and the plug 32 in the open position, water under pressure will fill the vent passage 68 and vent bypass 80, and force the ball 70 into sealing contact with the vent seat 78 against the spring 72 bias, preventing water from exiting the vent screw hole 76.

A bushing 82 is disposed within the bore 20 at the body second end 16. The bushing 82 has a hole 84 therethrough threadingly engaging the shaft 26. The bushing 82 is keyed to the body 12 by key 83 to prevent rotation. An inner seal 86 is mounted between the shaft 26 and the bushing 82 so as to prevent the leakage of water therebetween. An outer seal 88 is mounted between the body 12 and the bushing 82 so as to prevent the leakage of water therebetween. A cap 92 is threadingly mounted on the body second end 16 to retain the bushing 82 and the inner 86 and outer 88 seals. The shaft 26 projects through a hole 94 in the cap 92.

Stopping means is provided for stopping the shaft 26 as it moves into the plug 32 closed position at a predetermined point, so as to prevent damage to the plug and seat beveled surfaces, 38 and 24 respectively. Typically, the stopping means will comprise a pin 90 inserted through the bushing 82 and contacting the shaft thread 29.

Figure 8:
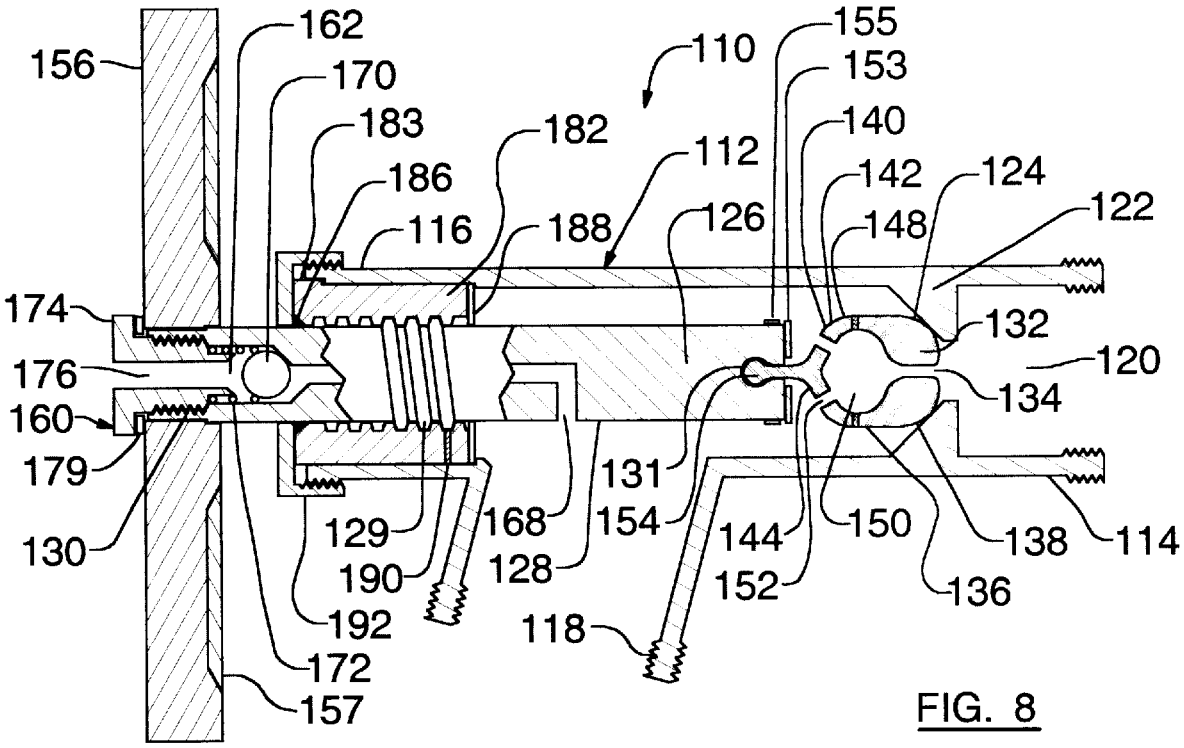
FIG. 8 is a side elevational, cross-sectional view of a freezeless hydrant constructed in accordance with the invention.
Figure 6:
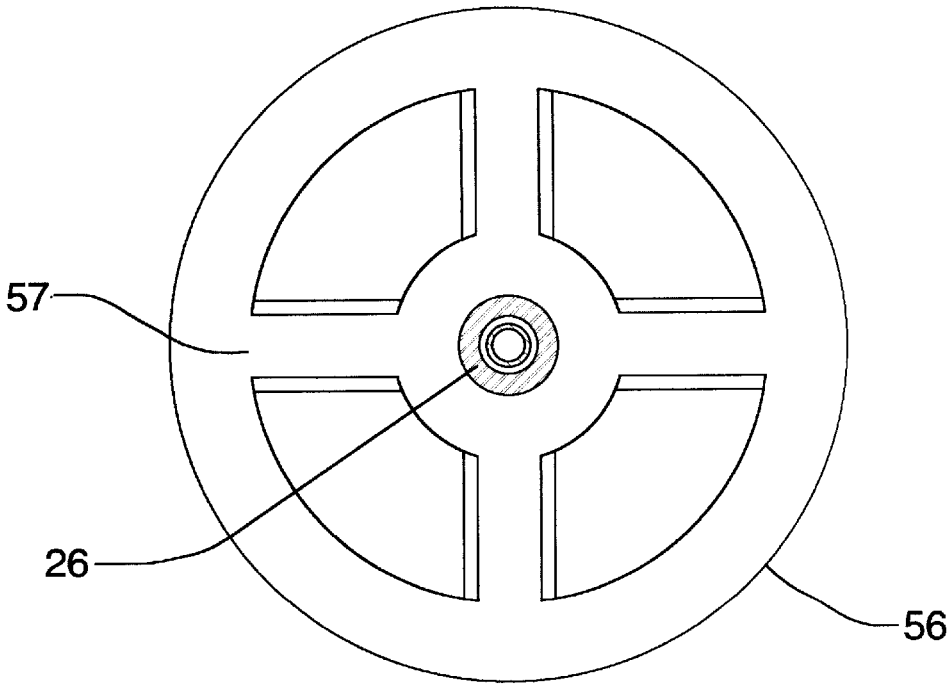
FIG. 6 is a cross-sectional view of the handwheel of the freezeless faucet of FIG. 1, taken along lines 6—6 of FIG. 1.

Referring now to FIG. 8, another embodiment of the invention, a freezeless hydrant, is shown at 110. Hydrant 110 is similar to faucet 10 except that the entire device is elongated, placing the water shut-off elements inside the building. Hydrant 110 comprises a body 112 extending between a first end 114 connected to the water supply and an opposite second end 116. The body 112 has a bore 120 therethrough. The body 112 also has a nozzle 118 intermediate the first 114 and second 116 ends. The nozzle 118 communicates with the bore 120 for discharging water. The bore 120 has an annular bore seat 122 intermediate the nozzle 118 and the first end 114. The bore seat 122 has a beveled surface 124 facing the body second end 116.

A shaft 126 having threads 129 is threadingly mounted generally collinearly within the bore 120. The shaft 126 extends between a first end 128 and an opposite second end 130 extending beyond the body second end 116. The shaft first end 128 includes a generally spherical socket 131. A handwheel 156 is attached to the shaft second end 130 for rotation therewith. The handwheel 156 includes a plurality of heat transfer surfaces 157 forming a heat sink, so as to shorten the thermal response time of the shaft 126 to rapid temperature changes.

A resilient plug 132 is disposed within the bore 120. The plug 132 has an orifice 134 therethrough communicating with the bore 120. The plug 132 has an outer periphery 136 with a beveled surface 138. The plug 132 is movable from a closed position in which the plug beveled surface 138 is juxtaposed sealingly against the bore seat beveled surface 124, to an open position in which the plug beveled surface 138 is apart from the bore seat beveled surface 124.

A backing member 140 has a conical portion 142, with a convex side 144, and a concave side 146 facing the plug 132. The conical portion 142 has a periphery 148 attached to the plug 132 forming a cavity 150 communicating with the orifice 134. The conical portion 142 has at least one hole 152 therethrough communicating the cavity 150 with the bore 120 downstream of the plug 132. The backing member 140 has a pivot ball 154 attached to the conical portion convex side 144. The pivot ball 154 is disposed within the socket 131. A retainer band 155 serves to keep the pivot ball 154 from slipping out of the socket 131. An isolation washer 153 helps to minimize heat transfer from the water to the shaft first end 128.

An air vent valve 160 selectively admits air into the body 112. The shaft second end 130 includes a vent cavity 162 generally collinear with the shaft 126. The vent cavity 162 extends from a proximal end 164 adjacent the shaft second end 130 to an opposite distal end 166.

The shaft 126 includes a vent passage 168 communicating the vent cavity distal end 166 with the bore 120. The air vent valve 160 includes a valve ball 170 disposed within the vent cavity 162. The valve ball 170 is smaller in diameter than the vent cavity 162. The air vent valve 160 has a spring 172 biasing the valve ball 170 toward the vent cavity distal end 166. The air vent valve 160 includes a vent screw 174 threadingly engaging the shaft second end 130. The vent screw 174 has a hole 176 therethrough and a vent seat 178 closely juxtaposed with the valve ball 170. The vent screw 174 is threadingly movable from a closed position wherein the vent seat 178 sealingly engages the valve ball 170 and holds the valve ball 170 against the distal end 166, to an open position wherein the vent seat 178 is spaced apart from the valve ball 170 allowing the vent cavity 162 to communicate with ambient air. A vent washer 179 seals the vent screw 174 threaded opening against leakage. The shaft 126 includes a vent bypass 180 at the vent cavity distal end 166 allowing air to flow freely around the valve ball 170 at the distal end 166.

A bushing 182 is disposed within the bore 120 at the body second end 116. The bushing 182 has a hole 184 therethrough threadingly engaging the shaft 126. The bushing 182 is keyed to the body 112 by key 183 to prevent rotation. An inner seal 186 is mounted between the shaft 126 and the bushing 182 so as to prevent the leakage of water therebetween. An outer seal 188 is mounted between the body 112 and the bushing 182 so as to prevent the leakage of water therebetween. A cap 192 is threadingly mounted on the body second end 116 to retain the bushing 182 and the inner 186 and outer 188 seals. The shaft 126 projects through a hole 194 in the cap 192.

Stopping means is provided for stopping the shaft 126 as it moves into the plug 132 closed position at a predetermined point, so as to prevent damage to the plug and seat beveled surfaces, 138 and 124 respectively. Typically, the stopping means will comprise a pin 190 inserted through the bushing 182 and contacting the shaft thread 129.

As seen from the foregoing description, the present invention satisfies the need to provide a faucet having both a thermally actuated drip valve so as not to freeze, and an anti-siphon bleed valve to avoid contaminating the water supply; a stop to limit damage to the valve seating surfaces by excessive torque applied to the handle; self alignment of the seating surfaces to prevent damage to the seat and leakage; and a heat sink to conduct heat from the thermal actuator to the ambient air to shorten response time in the event of rapid temperature change.

Although the invention has been described and illustrated in the preferred embodiments, those skilled in the art will make changes that will be seen to be functional equivalents to the present invention. It is therefore to be understood that the above detailed description of embodiments of the invention is provided by way of example only. Various details of design and construction may be modified without departing from the true spirit and scope of the invention as set forth in the appended claims.

The embodiments of the invention in which an exclusive property or privilege is claimed are defined as follows:

1. A freezeless faucet, for use in connection with a water supply, the faucet comprising:

(a) a body extending between a first end connected to the water supply and an opposite second end, the body having a bore therethrough, the body having a nozzle intermediate the first and second ends, the nozzle communicating with the bore for discharging water, the bore having an annular bore seat intermediate the nozzle and the first end, the bore seat having a beveled surface facing the body second end;

(b) a plug disposed within the bore, the plug being resilient, the plug having an orifice therethrough communicating with the bore, the plug having an outer periphery with a beveled surface, the plug being movable from a closed position in which the plug beveled surface is juxtaposed sealingly against the bore seat beveled surface, to an open position in which the plug beveled surface is apart from the bore seat beveled surface;

(c) a shaft threadingly mounted generally collinearly within the bore, the shaft extending between a first end connected to the plug and an opposite second end extending beyond the body second end; and (d) a handwheel attached to the shaft second end for rotation therewith; so that (e) as the handwheel is rotated in a first direction, the shaft moves the plug into the closed position to stop water flowing past the bore seat and around the plug periphery, the beveled surfaces cause the plug to compress radially inward, closing the orifice to stop water flowing therethrough, and as the handwheel is rotated in an opposite second direction, the shaft moves the plug into the open position to allow water to flow past the bore seat, around the plug periphery, and toward the nozzle, the plug radial compression is relieved, allowing the orifice to open and water to flow therethrough, and with the plug in the closed position, a decrease in ambient temperature generally below freezing will cause the shaft to contract, thereby reducing the plug radial compression, allowing the orifice to open sufficiently for water to drip therethrough, preventing upstream piping from freezing.

2. The faucet of claim 1, wherein:

(a) the shaft first end includes a generally spherical socket; and (b) the faucet further comprises a backing member having a conical portion, the conical portion having a convex side, the conical portion having a concave side facing the plug, the conical portion having a periphery attached to the plug forming a cavity communicating with the orifice, the conical portion having at least one hole therethrough communicating the cavity with the bore downstream of the plug so that water passing through the orifice will pass through the cavity and through the hole, the backing member having a pivot ball attached to the conical portion convex side, the pivot ball being disposed within the socket so as to allow the plug to align with the bore seat for watertight sealing, and to prevent the plug from rotating with respect to the shaft, to minimize plug wear.

3. The faucet of claim 2, further comprising an air vent valve to selectively admit air into the body so as to allow draining of water from the bore and nozzle, and to prevent siphoning of contaminants into the water supply.

4. The faucet of claim 3, wherein:

(a) the shaft second end includes a vent cavity generally collinear with the shaft, the vent cavity extending from a proximal end adjacent the shaft second end to an opposite distal end;

(b) the shaft includes a vent passage communicating the vent cavity distal end with the bore;

(c) the air vent valve includes a valve ball disposed within the vent cavity, the valve ball being smaller in diameter than the vent cavity;

(d) the air vent valve includes a spring biasing the valve ball toward the vent cavity distal end;

(e) the air vent valve includes a vent screw threadingly engaging the shaft second end, the vent screw having a hole therethrough and a vent seat closely juxtaposed with the valve ball, the vent screw being threadingly movable from a closed position wherein the vent seat sealingly engages the valve ball and holds the valve ball against the distal end, to an open position wherein the vent seat is spaced apart from the valve ball allowing the vent cavity to communicate with ambient air; and (d) the shaft includes a vent bypass at the vent cavity distal end allowing air to flow freely around the valve ball at the distal end; so that (e) with the vent screw in the closed position, fluids cannot flow past the valve ball, and with the vent screw in the open position and the plug in the closed position, ambient air will flow through the vent screw hole, past the vent seat, around the valve ball, through the vent bypass, through the vent passage, and into the bore, displacing and allowing water to drain from the bore, and with the vent screw in the open position and the plug in the open position, water under pressure will fill the vent passage and vent bypass, and force the ball into sealing contact with the vent seat against the spring bias, preventing water from exiting the vent screw hole.

5. The faucet of claim 2, wherein the handwheel includes a plurality of heat transfer surfaces, forming a heat sink, so as to shorten the thermal response time of the shaft to rapid temperature changes.

6. A freezeless faucet for use in connection with a water supply, the faucet comprising:

(a) a body extending between a first end connected to the water supply and an opposite second end, the body having a bore therethrough, the body having a nozzle intermediate the first and second ends, the nozzle communicating with the bore for discharging water, the bore having an annular bore seat intermediate the nozzle and the first end, the bore seat having a beveled surface facing the body second end;

(b) a shaft threadingly mounted generally collinearly within the bore, the shaft extending between a first end and an opposite second end extending beyond the body second end, the shaft first end including a generally spherical socket;

(c) a plug disposed within the bore, the plug being resilient, the plug having an orifice therethrough communicating with the bore, the plug having an outer periphery with a beveled surface, the plug being movable from a closed position in which the plug beveled surface is juxtaposed sealingly against the bore seat beveled surface, to an open position in which the plug beveled surface is apart from the bore seat beveled surface;

(d) a backing member having a conical portion, the conical portion having a convex side, the conical portion having a concave side facing the plug, the conical portion having a periphery attached to the plug forming a cavity communicating with the orifice, the conical portion having at least one hole therethrough communicating the cavity with the bore downstream of the plug so that water passing through the orifice will pass through the cavity and through the hole, the backing member having a pivot ball attached to the conical portion convex side, the pivot ball being disposed within the socket so as to allow the plug to align with the bore seat for watertight sealing, and to prevent the plug from rotating with respect to the shaft, to minimize plug wear; and (e) a handwheel attached to the shaft second end for rotation therewith; so that (f) as the handwheel is rotated in a first direction, the shaft moves the plug into the closed position to stop water flowing past the bore seat and around the plug periphery, the beveled surfaces cause the plug to compress radially inward, closing the orifice to stop water flowing therethrough, and as the handwheel is rotated in an opposite second direction, the shaft moves the plug into the open position to allow water to flow past the bore seat, around the plug periphery, and toward the nozzle, the plug radial compression is relieved, allowing the orifice to open and water to flow therethrough, and with the plug in the closed position, a decrease in ambient temperature generally below freezing will cause the shaft to contract thereby reducing the plug radial compression, allowing the orifice to open sufficiently for water to drip therethrough, preventing upstream piping from freezing.

7. The faucet of claim 6, further comprising an air vent valve to selectively admit air into the body so as to allow draining of water from the bore and nozzle, and to prevent siphoning of contaminants into the water supply.

8. The faucet of claim 7, wherein:

(a) the shaft second end includes a vent cavity generally collinear with the shaft, the vent cavity extending from a proximal end adjacent the shaft second end to an opposite distal end;

(b) the shaft includes a vent passage communicating the vent cavity distal end with the bore;

(c) the air vent valve includes a valve ball disposed within the vent cavity, the valve ball being smaller in diameter than the vent cavity;

(d) the air vent valve includes a spring biasing the valve ball toward the vent cavity distal end;

(e) the air vent valve includes a vent screw threadingly engaging the shaft second end, the vent screw having a hole therethrough and a vent seat closely juxtaposed with the valve ball, the vent screw being threadingly movable from a closed position wherein the vent seat sealingly engages the valve ball and holds the valve ball against the distal end, to an open position wherein the vent seat is spaced apart from the valve ball allowing the vent cavity to communicate with ambient air; and (d) the shaft includes a vent bypass at the vent cavity distal end allowing air to flow freely around the valve ball at the distal end, so that (e) with the vent screw in the closed position, fluids cannot flow past the valve ball, and with the vent screw in the open position and the plug in the closed position, ambient air will flow through the vent screw hole, past the vent seat, around the valve ball, through the vent bypass, through the vent passage, and into the bore, displacing and allowing water to drain from the bore, and with the vent screw in the open position and the plug in the open position, water under pressure will fill the vent passage and vent bypass, and force the ball into sealing contact with the vent seat against the spring bias, preventing water from exiting the vent screw hole.

9. The faucet of claim 6, wherein the handwheel includes a plurality of heat transfer surfaces, forming a heat sink, so as to shorten the thermal response time of the shaft to rapid temperature changes.

10. A freezeless faucet, for use in connection with a water supply, the faucet comprising:

(a) a body extending between a first end connected to the water supply and an opposite second end, the body having a bore therethrough, the body having a nozzle intermediate the first and second ends, the nozzle communicating with the bore for discharging water, the bore having an annular bore seat intermediate the nozzle and the first end, the bore seat having a beveled surface facing the body second end;

(b) a shaft threadingly mounted generally collinearly within the bore, the shaft extending between a first end and an opposite second end extending beyond the body second end, the shaft first end including a generally spherical socket;

(c) a plug disposed within the bore, the plug being resilient, the plug having an orifice therethrough communicating with the bore, the plug having an outer periphery with a beveled surface, the plug being movable from a closed position in which the plug beveled surface is juxtaposed sealingly against the bore seat beveled surface, to an open position in which the plug beveled surface is apart from the bore seat beveled surface;

(d) a backing member having a conical portion, the conical portion having a convex side, the conical portion having a concave side facing the plug, the conical portion having a periphery attached to the plug forming a cavity communicating with the orifice, the conical portion having at least one hole therethrough communicating the cavity with the bore downstream of the plug so that water passing through the orifice will pass through the cavity and through the hole, the backing member having a pivot ball attached to the conical portion convex side, the pivot ball being disposed within the socket so as to allow the plug to align with the bore seat for watertight sealing, and to prevent the plug from rotating with respect to the shaft, to minimize plug wear;

(e) a handwheel attached to the shaft second end for rotation therewith; and (f) stopping means for stopping the shaft movement into the plug closed position at a predetermined point, so as to prevent damage to the plug and seat beveled surfaces; so that (g) as the handwheel is rotated in a first direction, the shaft moves the plug into the closed position to stop water flowing past the bore seat and around the plug periphery, the beveled surfaces cause the plug to compress radially inward, closing the orifice to stop water flowing therethrough, and as the handwheel is rotated in an opposite second direction, the shaft moves the plug into the open position to allow water to flow past the bore seat, around the plug periphery, and toward the nozzle, the plug radial compression is relieved, allowing the orifice to open and water to flow therethrough, and with the plug in the closed position, a decrease in ambient temperature generally below freezing will cause the shaft to contract, thereby reducing the plug radial compression, allowing the orifice to open sufficiently for water to drip therethrough, preventing upstream piping from freezing.

11. The faucet of claim 10, further comprising an air vent valve to selectively admit air into the body so as to allow draining of water from the bore and nozzle, and to prevent siphoning of contaminants into the water supply.

12. The faucet of claim 11, wherein:

(a) the shaft second end includes a vent cavity generally collinear with the shaft, the vent cavity extending from a proximal end adjacent the shaft second end to an opposite distal end;

(b) the shaft includes a vent passage communicating the vent cavity distal end with the bore;

(c) the air vent valve includes a valve ball disposed within the vent cavity, the valve ball being smaller in diameter than the vent cavity;

(d) the air vent valve includes a spring biasing the valve ball toward the vent cavity distal end;

(e) the air vent valve includes a vent screw threadingly engaging the shaft second end, the vent screw having a hole therethrough and a vent seat closely juxtaposed with the valve ball, the vent screw being threadingly movable from a closed position wherein the vent seat sealingly engages the valve ball and holds the valve ball against the distal end, to an open position wherein the vent seat is spaced apart from the valve ball allowing the vent cavity to communicate with ambient air; and (d) the shaft includes a vent bypass at the vent cavity distal end allowing air to flow freely around the valve ball at the distal end; so that (e) with the vent screw in the closed position, fluids cannot flow past the valve ball, and with the vent screw in the open position and the plug in the closed position, ambient air will flow through the vent screw hole, past the vent seat, around the valve ball, through the vent bypass, through the vent passage, and into the bore, displacing and allowing water to drain from the bore, and with the vent screw in the open position and the plug in the open position, water under pressure will fill the vent passage and vent bypass, and force the ball into sealing contact with the vent seat against the spring bias, preventing water from exiting the vent screw hole.

13. The faucet of claim 10, wherein the handwheel includes a plurality of heat transfer surfaces, forming a heat sink, so as to shorten the thermal response time of the shaft to rapid temperature changes.

14. The faucet of claim 10, further comprising:

(a) a bushing disposed within the bore at the body second end, the bushing having a hole therethrough threadingly engaging the shaft, the bushing being keyed to the body to prevent rotation;

(b) an inner seal mounted between the shaft and the bushing so as to prevent the leakage of water therebetween;

(c) an outer seal mounted between the body and the bushing so as to prevent the leakage of water therebetween; and (d) a cap threadingly mounted on the body second end to retain the bushing and the inner and outer seals, the shaft projecting through a hole in the cap.

* * * * *